US006988502B2

(12) United States Patent
Tsukamoto

(10) Patent No.: US 6,988,502 B2
(45) Date of Patent: Jan. 24, 2006

(54) ARTIFICIAL FINGERNAIL REMOVER

(76) Inventor: Chihiro Tsukamoto, 1, Toyotamakita 3-chome, Nerima-ku, Tokyo (JP) 176-0012

( * ) Notice: Subject to any disclaimer, the term of this patent is extended or adjusted under 35 U.S.C. 154(b) by 0 days.

(21) Appl. No.: 10/634,313

(22) Filed: Aug. 5, 2003

(65) Prior Publication Data

US 2004/0025896 A1 Feb. 12, 2004

(30) Foreign Application Priority Data

Aug. 5, 2002 (JP) ..... P2002-227098

(51) Int. Cl.
*A45D 24/00* (2006.01)
*A45D 29/00* (2006.01)

(52) U.S. Cl. ..... 132/200; 132/73

(58) Field of Classification Search ..... 132/73.5, 132/74.5, 75, 200, 73
See application file for complete search history.

(56) References Cited

U.S. PATENT DOCUMENTS 3,124,825 A * 3/1964 Oivenko ..... 15/104.93
4,800,904 A * 1/1989 Kinseley et al. ..... 132/73.5
5,613,506 A * 3/1997 Kurokawa ..... 132/73

* cited by examiner

*Primary Examiner*—John J. Wilson
*Assistant Examiner*—Robyn Doan
(74) *Attorney, Agent, or Firm*—Bachman & LaPointe, P.C.

(57) ABSTRACT

An artificial fingernail remover is provided that comprises a receptacle 1 formed with an opened end 3, a closed end 4 and a cavity 1*a* defined between the opened and closed ends 3, 4; and an absorbent 2 disposed in the receptacle 1 and secured to the closed end 4 of the receptacle 1 to absorb a solvent in absorbent 2. When a tip of a single finger is inserted into receptacle 1 to bring the artificial fingernail 7 attached to a natural nail into contact with absorbent 2, resin of the artificial nail 7 is dissolved or softened by the solvent, and the artificial nail 7 can be easily scrapped off the natural nail in a relatively short period of time.

7 Claims, 2 Drawing Sheets

ARTIFICIAL FINGERNAIL REMOVER

TECHNICAL FIELD

This invention relates to an artificial fingernail remover for taking the artificial nail off a natural nail by inserting the artificial nail into the remover for dissolution or softening of the artificial nail in contact with solvent in the remover.

BACKGROUND OF THE INVENTION

For example, Japanese Patent Disclosure No. 2001-353021 published Dec. 25, 2001 discloses a method for forming an artificial fingernail with a forming set that comprises an extension or substrate for attachment to a natural nail, an adhesive for adhering the substrate to the natural nail, acrylic resin powder used as acrylic resin layer adhered on the substrate with an adhesive, and a file for polishing a surface of the substrate to a final shape. In this reference, the substrate and acrylic resin powder layer are attached in turn on the natural nail to form a bonded integral nail structure of the substrate and acrylic resin layer, and thereby make the artificial nail into a desirable shape via relatively easy processes during a short period of time at inexpensive cost.

U.S. Pat. No. 5,806,536 issued on Sep. 15, 1998 to Marlene Tietjen describes an artificial nail removal arrangement that comprises a vessel having a cylindrical wall to contain an abrasive pad of rough fibers and a solvent, and a solvent contained in the vessel. In this patent, a finger or several fingers are inserted into a central hole formed in the abrasive pad to rub an artificial nail attached on a natural nail and scrap the artificial nail in solvent off the natural nail.

U.S. Pat. No. 5,921,250 issued on Jul. 13, 1999 to Cord L. Rhea et al. demonstrates an artificial nail remover container device that comprises a container, a solvent such as acetone contained in the container, an inner chamber filled with hot water for warming the acetone wherein the artificial nail attached on a natural nail is immerged in the heated acetone to remove the artificial one.

Also, U.S. Pat. No. 6,367,485 issued on Apr. 9, 2002 to Audrey Shelby Dotton-Davis et al., exhibits an acrylic fingernail removal strip formed into a generally "H" shape with adhesive on each end of the strip. An absorbent pad element is affixed to the center portion of the strip to allow user to apply acetone onto the absorbent pad when an artificial nail to be removed is wrapped with the removal strip so that the nail is soaked in acetone and the strip retains heat therein to aid the acetone in the removal process.

However, prior art removal devices have their expensive and large-scale structure, and requires complicated removal operation, and therefore, there is a need for providing a new artificial fingernail remover of simple structure for easy handling.

An object of the present invention is to provide an artificial fingernail remover of simple structure capable of effectively removing the artificial nail from a natural nail. Another object of the present invention is to provide a portable and disposable remover for easy separating operation of artificial nail. Still another object of the present invention is to provide an artificial fingernail remover independently attachable to each finger.

SUMMARY OF THE INVENTION

An artificial fingernail remover according to the present invention comprises a receptacle (1) formed with an opened end (3), a closed end (4) and a cavity (1*a*) defined between the opened and closed ends (3, 4); and an absorbent (2) disposed in the receptacle (1) and secured to the closed end (4) of the receptacle (1) to absorb a solvent. The receptacle (1) is formed of flexible and airtight material into a sack shape for receiving a tip of a user's finger (8). An artificial fingernail (7) attached to a natural finger nail can be brought into contact with the absorbent (2) to dissolve or soften resin of the artificial nail (7) by solvent retained in the absorbent (2).

BRIEF DESCRIPTION OF THE DRAWINGS

The above-mentioned and other objects and advantages of the present invention will be apparent from the following description in connection with preferred embodiments shown in the accompanying drawings wherein.

BEST MODE FOR CARRYING OUT THE INVENTION

Figure 1:
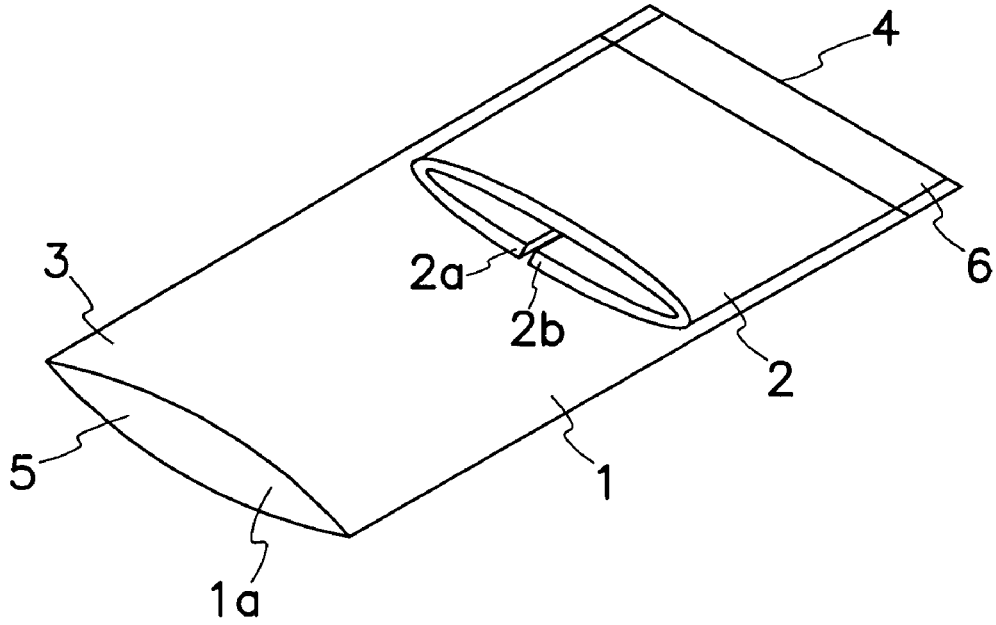
FIG. 1 is a perspective view showing a front side of the artificial fingernail remover according to the present invention.
Figure 2:
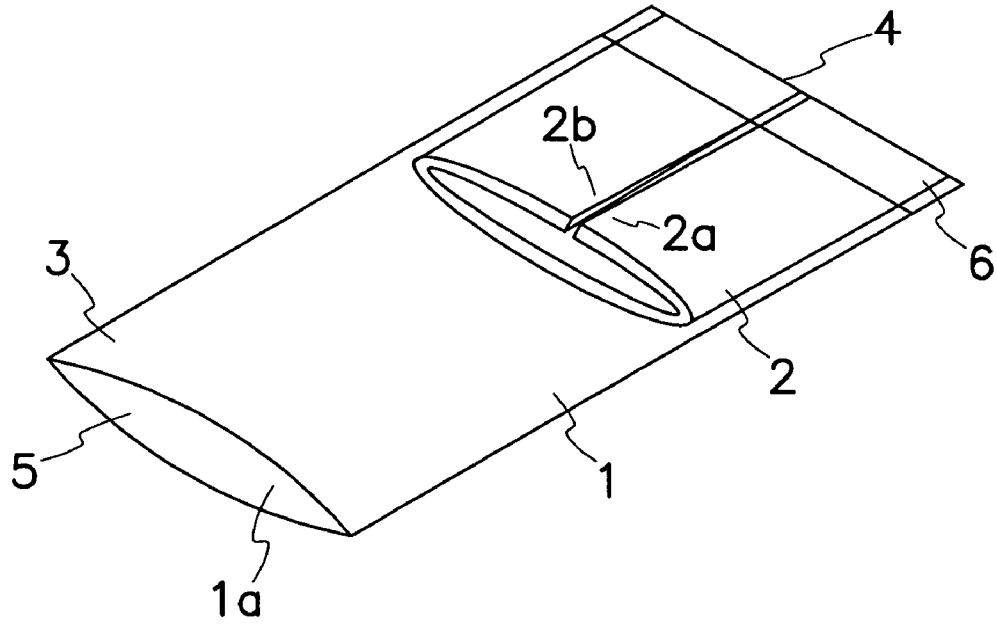
FIG. 2 is a perspective view showing a back side of the remover according to the present invention.

As shown in FIGS. 1 and 2, the artificial fingernail remover according to the present invention comprises a receptacle 1 formed into a sack or stall shape, and an absorbent 2 disposed in and secured to receptacle 1. Receptacle 1 is formed with an opened end 3 for forming an opening 5, a closed end 4 for forming a closure 6 and an inner cavity 1*a* defined between the opened and closed ends 3, 4. Receptacle 1 is made of a flexible and transparent or semitransparent resin sheet or film of a material selected from the group consisting of, for example, polyolefin such as polyethylene (PE) or polypropylene (PP), polyamide or Nylon (NY), ethylene vinyl acetate copolymer (EVA), polyethylene terephthalate (PET) and vinylidene chloride (KOP). Preferable polyethylene may include either of high density polyethylene (HDPE) and low density polyethylene (LDPE). Preferable polypropylene includes oriented PP (OPP) film and unstretched PP (CPP) film. Selected resin for forming receptacle 1 is of preferably 0.005 mm to 1 mm, more preferably 0.01 mm to 0.5 mm, most preferably 0.02 mm to 0.1 mm in thickness to provide receptacle 1 with a flexible, airtight and liquid-tight structure that can be easily opened and prevent leakage of gas and liquid out of receptacle 1 except from opened end 3. In the shown embodiment, receptacle 1 is formed into a folded cylindrical shape of a seamless structure without welded portion except closure 6 because folded shape of receptacle 1 is convenient for manufacture, expansion into the sack or stall shape and simultaneous transportation of accumulated sets of flat receptacles 1.

Absorbent 2 is also formed into a folded cylindrical shape of a liquid-impregnant material selected from the group consisting of foamed resin of polyethylene, polyurethane, sponge of organic material, cloth or a woven or nonwoven fabric of natural or artificial cellulose material for absorbing and retaining solvent. Absorbent 2 may have separated opposite ends 2*a*, 2*b* facing each other, but alternatively, opposite ends 2*a*, 2*b* may be jointed by heat-sealing or welding.

One end of absorbent 2 is adhered or bonded to closed end 4 of receptacle 1 by heat-sealing or welding, and the other end is free so that a length of the absorbent 2 is shorter than that of receptacle 1. Upon heat-sealing or welding, any additional reinforcement sheet (not shown) may be attached to an outer surface of receptacle 1 for integral heat-sealing. Solvent imbibed by or impregnated into absorbent 2 is selected from the group consisting of acetone, alcohol, amyl acetate and ethyl acetate. Each of receptacle 1 and absorbent 2 is made of a material that is resistible to solvent or cannot be dissolved or softened by solvent.

Figure 3:
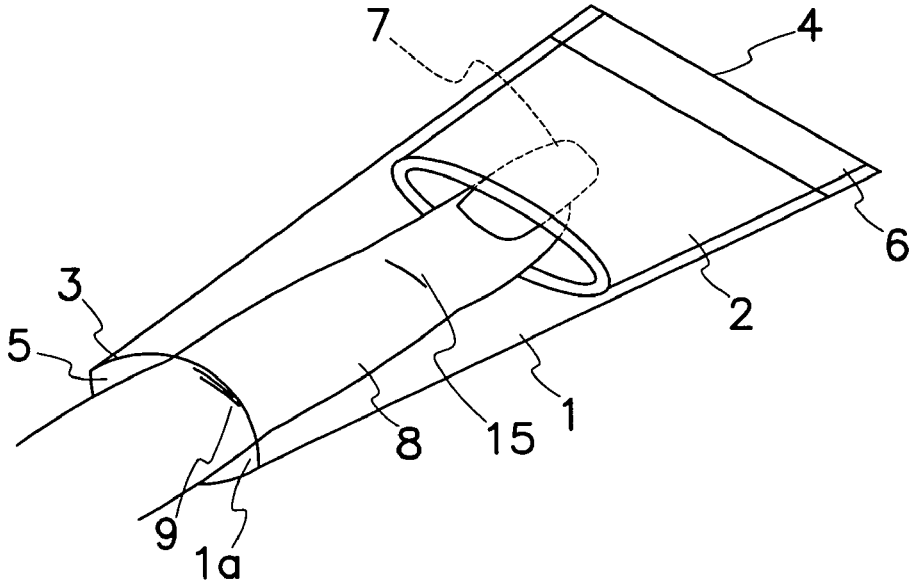
FIG. 3 is a perspective view showing the remover into which a finger tip is inserted.

In use, opening 5 can be manually expanded as shown in FIG. 3 to form an inlet for a finger 8, and a suitable amount of solvent is dropped on absorbent 2 in receptacle 1 to impregnate solvent into absorbent 2. Dropped on absorbent 2 is a very small amount of odoriferous solvent that is enough to remove artificial fingernail 7, causing very little impact upon environmental pollution. When a finger 8 with artificial nail 7 is inserted into receptacle 1, a tip, first joint 15 or at the most near second joint 9 of a single finger is inserted into receptacle 1 to bring the whole artificial nail 7 into contact with absorbent 2. For example, absorbent 2 is designed to have the size wherein only a nail portion of finger or only a finger tip extending from a first joint 15 is brought into contact with absorbent 2 when a natural nail with artificial nail 7 is inserted into receptacle 1. In this case, as absorbent 2 has the size for generally enclosing artificial nail 7 and natural nail, unnecessary amount of solvent is not attached to first joint 15 and root side of finger 8. Inner cavity 1*a* of receptacle 1 is designed to have the volume to receive a tip of a user's finger 8, and it is slightly larger than tip of natural finger 8. As inner volume in receptacle 1 is relatively small, solvent is heated by temperature of natural finger 8 and heat of dissolution to promote dissolution and softening of resin of artificial nail 7, while receptacle 1 and absorbent 2 are effective to keep heat in receptacle 1. When resin of artificial nail 7 is dissolved or softened in solvent, receptacle 1 and absorbent 2 may be gripped from outside by hand or some tool, and external force can be applied to artificial nail 7 to accelerate removal of artificial nail 7.

It should be noted that in the present invention, during contact of artificial nail 7 with solvent in absorbent 2, resin of artificial nail 7 is dissolved or softened by solvent, and simultaneously, fibers or surface protrusions of absorbent 2 can invade artificial nail 7 so that resin of artificial nail 7 serves to physically bond a surface structure of absorbent 2 and artificial nail 7 to prevent detachment of the remover from artificial nail 7. Thus, dissolution or softening of artificial nail resin is accelerated, and artificial nail 7 can easily be removed from the natural nail in a relatively short period of time. Artificial nail 7 may include nail extensions and other attachments to nails and is typically formed of acrylic or one of other resins and bonded to a natural nail with for example a cyanoacrylate adhesive soluble in solvent. To assist bonding of absorbent 2 to artificial nail resin, absorbent 2 is preferably formed of foamed resin that has suitable elasticity and flexibility.

To reduce, deodorize or control odoriferous smell of solvent such as acetone, deodorant or aromatic agent may be added to solvent, such as a fruity smell ingredient selected from the group consisting of amyl acetate, ethyl acetate, isoamyl isovalerate, a malic acid or citric acid, or vegetable essence selected from the group consisting of jasmine and linalyl acetate. For example, one or more of these deodorants may be added to solvent alone or with solvent for deodorant with 0.01 to 3.0%, preferably 0.05 to 1.0%, more preferably 0.1 to 0.5% by weight of deodorant.

In a prior art nail remover arrangement, all five or a plurality of fingers must be simultaneously immerged in acetone to soften each artificial nail resin. In this case, after a first artificial nail is removed from natural fingers, the remaining artificial nails must again be immerged in acetone. In addition, user of artificial nails cannot leave the nail remover arrangement while her finger tips are immerged in acetone. Unlike such a prior art method, the present invention enables the remover to separately be applied to individual finger so that an artificial nail can be removed from each finger, while keeping the remaining removers attached to the other finger tips for successive dissolution and softening. Accordingly, immediately after the first artificial nail has been removed, user can try to efficiently remove a next artificial nail in contact with solvent in the remover. Furthermore, in the present invention, user can walk with the remover or removers attached to her fingers and can do some work with the removers as well.

EXAMPLE

Figure 4:
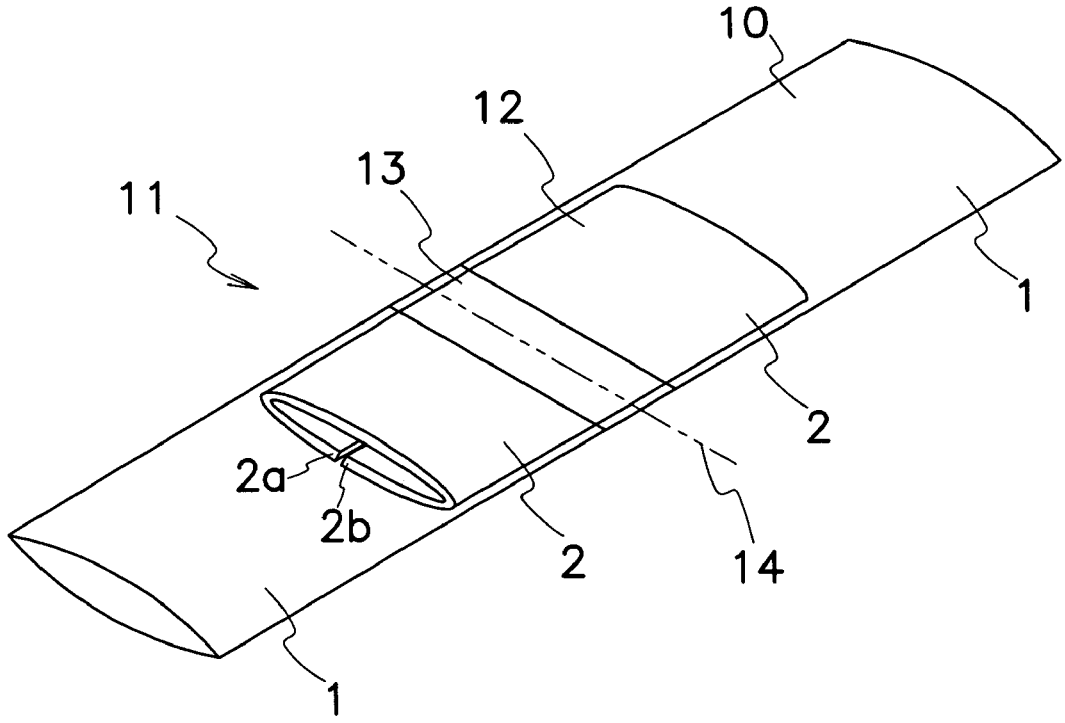
FIG. 4 is a perspective view depicting a process in manufacture of the remover of the present invention.

The removers according to the present invention were made in the following method. Firstly, a transparent and flexible casing 10 of polyethylene was formed as shown in FIG. 4 with length of 120 mm, thickness of 0.1 mm and width of 28 to 34 mm. Typically, casing 10 was formed into a flat cylindrical shape with opposite opened ends but without any longitudinal heat sealed or jointed portion. A rectangular sheet 12 made of foamed polyethylene was prepared in length of 55 mm, width of 54 mm and thickness of 3 mm, folded in two and then inserted into casing 10 at the center to form absorbent 2. Subsequently, a transverse sealed area 13 of constant width was formed at the center of and across casing 10 by heat-sealing to form a casing unit 11. As shown in FIG. 4, if absorbent 2 of double length was disposed in and at the center of receptacle 1 of double length, two removers could efficiently be produced at once when receptacle 1 and absorbent were widthwise hot-pressed and cut at the center. Then, casing unit 11 was cut along a central line 14 perpendicular to a longitudinal direction of casing unit 11 to provide two removers according to the present invention.

As mentioned above, the remover of the instant invention is very convenient because it is portable and disposable or recyclable after removal for artificial nails. Also, artificial nails can easily be scrapped off natural nails by contact of artificial nails to a little amount of solvent.

What is claimed is:

1. A method for removing an artificial fingernail from user's fingernail comprising the steps of:

preparing an artificial fingernail remover which comprises a receptacle and absorbent disposed in the receptacle, wherein said receptacle is formed of a flexible and airtight resin sheet of 0.005 mm to 1.0 mm in thickness into a sack shape; said receptacle has an opened end, a closed end and a cavity defined between said opened and closed ends; and said absorbent has the suitable elasticity and flexibility and is secured to the closed end of said receptacle;

dropping a solvent through the opened end in said receptacle to impregnate said solvent into said absorbent;

just after the dropping, inserting a user's finger and an artificial fingernail attached to the user's fingernail through the opened end into the cavity so that the artificial fingernail is brought into contact with said absorbent until nearly second joint of the user's finger is received in said receptacle; and dissolving or softening resin of said artificial fingernail by said solvent retained in said absorbent.

2. The method of claim 1, wherein said receptacle is formed of a resin selected from the group consisting of polyethylene, polyamide, polypropylene, ethylene vinyl acetate copolymer, polyethylene terephthalate and vinylidene chloride.

3. The method of claim 1, wherein said absorbent is formed of a material selected from the group consisting of foamed resin of polyethylene or polyurethane, sponge of organic material, cloth or woven or nonwoven fabric.

4. The method of claim 1, wherein said absorbent is adhered to the closed end of said receptacle by heat-sealing or welding.

5. The method of claim 1, wherein the solvent absorbed by said absorbent is selected from the group consisting of acetone, alcohol, amyl acetate and ethyl acetate.

6. The method of claim 1, wherein each of said receptacle and absorbent is made of a material that cannot be dissolved or softened by the solvent.

7. The method of claim 1, wherein said absorbent has the length shorter than that of said receptacle.

* * * * *